US009797365B2

(12) United States Patent
Schenk et al.

(10) Patent No.: US 9,797,365 B2
(45) Date of Patent: Oct. 24, 2017

(54) METHOD FOR CONTROLLING A CORONA IGNITION SYSTEM OF A CYCLICALLY OPERATING INTERNAL COMBUSTION ENGINE

(71) Applicant: BorgWarner Ludwigsburg GmbH, Ludwigsburg (DE)

(72) Inventors: Alexander Schenk, Waiblingen (DE); Torsten Schremmer, Ludwigsburg (DE); Georg Rixecker, Leinfelden-Echterdingen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 326 days.

(21) Appl. No.: 14/642,434

(22) Filed: Mar. 9, 2015

(65) Prior Publication Data

US 2015/0260147 A1 Sep. 17, 2015

(30) Foreign Application Priority Data

Mar. 13, 2014 (DE) ..... 10 2014 103 414

(51) Int. Cl.
*F02P 23/04* (2006.01)
*F02P 3/01* (2006.01)
(Continued)

(52) U.S. Cl.
CPC ..... *F02P 23/04* (2013.01); *F02D 35/028* (2013.01); *F02D 41/1401* (2013.01); *F02P 3/01* (2013.01);
(Continued)

(58) Field of Classification Search
CPC .... F02P 23/04; F02P 3/01; F02P 9/007; F02P 17/12; F02P 7/08; F02P 2017/121; F02D 41/1401; F02B 77/085
(Continued)

(56) References Cited

U.S. PATENT DOCUMENTS 9,091,244 B2 7/2015 Trump et al.
2011/0114071 A1 5/2011 Freen
(Continued)

FOREIGN PATENT DOCUMENTS

DE 10 2012 104 654 B3 11/2013
DE 10 2012 104 642 A1 12/2013

*Primary Examiner* — Mahmoud Gimie
(74) *Attorney, Agent, or Firm* — Bose McKinney & Evans LLP

(57) ABSTRACT

A method for controlling a corona ignition system in which a corona discharge is produced at an ignition electrode by exciting a resonating circuit with an AC voltage produced by a high-frequency generator. The AC voltage is adjusted to a target value depending on an operating state of the engine. Combustion onset is determined by evaluating an electrical variable of the resonating circuit and the target value of the AC voltage is reduced by a predefined value following a predefined number of engine cycles or a predefined operating period. The determined combustion onset is evaluated in one or more engine cycles. The target value for the momentary engine operating state is then increased if, by evaluation of the combustion onset, it is found that a predefined requirement is no longer met. Otherwise, the reduced target value is stored as a new target value for the momentary engine operating state.

10 Claims, 1 Drawing Sheet

(51) Int. Cl.

| | |
|---|---|
| ***F02D 41/14*** | (2006.01) |
| ***F02P 9/00*** | (2006.01) |
| ***F02P 17/12*** | (2006.01) |
| ***F02D 35/02*** | (2006.01) |
| *F02P 7/03* | (2006.01) |
| *F02B 77/08* | (2006.01) |

(52) U.S. Cl.
CPC ..... *F02P 9/007* (2013.01); *F02P 17/12* (2013.01); *F02B 77/085* (2013.01); *F02P 7/03* (2013.01); *F02P 2017/121* (2013.01)

(58) Field of Classification Search
USPC ..... 123/406.19, 143 B, 146.5 R, 623; 73/114.59
See application file for complete search history.

(56) References Cited

U.S. PATENT DOCUMENTS

| | | | | |
|---|---|---|---|---|
| 2011/0305998 | A1* | 12/2011 | Toedter | F02P 3/01 431/2 |
| 2012/0249163 | A1* | 10/2012 | Burrows | F02P 23/04 324/633 |
| 2013/0013167 | A1* | 1/2013 | Schremmer | F02P 23/045 701/102 |
| 2013/0199508 | A1* | 8/2013 | Toedter | F02P 23/04 123/594 |
| 2013/0208393 | A1* | 8/2013 | Hampton | F02P 9/002 361/247 |
| 2013/0319095 | A1 | 12/2013 | Trump et al. | |
| 2013/0325302 | A1 | 12/2013 | Trump et al. | |
| 2014/0174392 | A1* | 6/2014 | Burrows | F02P 23/04 123/143 B |

* cited by examiner

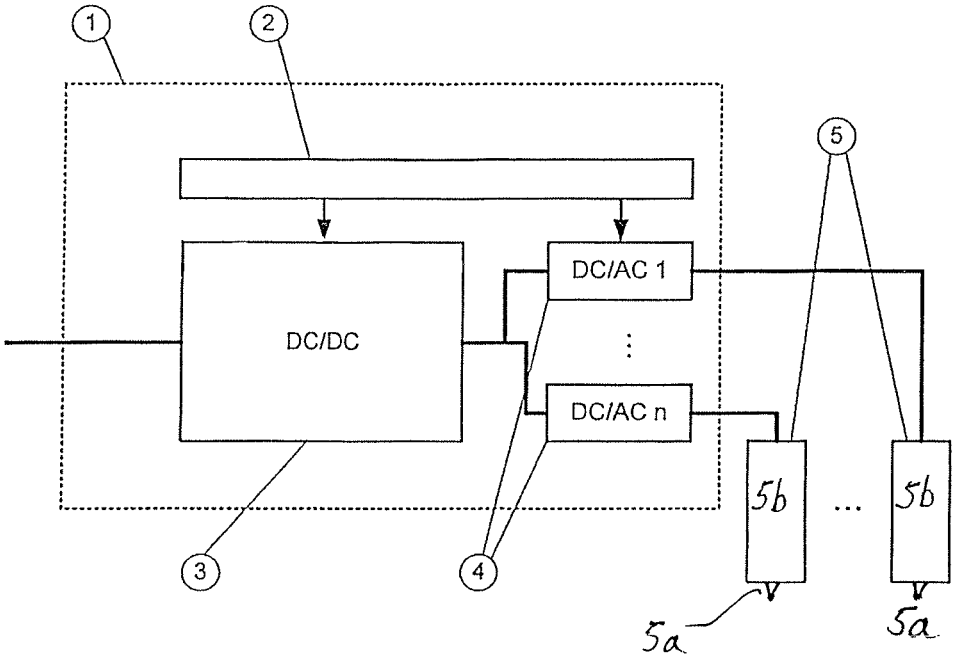
1
2
5
DC/DC
DC/AC 1
DC/AC n
5b
...
5b
3
4
5a
5a

METHOD FOR CONTROLLING A CORONA IGNITION SYSTEM OF A CYCLICALLY OPERATING INTERNAL COMBUSTION ENGINE

RELATED APPLICATIONS

This application claims priority to DE 10 2014 103 414.7, filed Mar. 13, 2014, the entire disclosure of which is hereby incorporated herein by reference in its entirety.

BACKGROUND

The invention relates to a method for controlling a corona ignition system of a cyclically operating internal combustion engine. Methods of this type are generally known in, e.g., US 2013/0319095 A1.

US 2011/0114071 A1 discloses a corona system for igniting a fuel/air mixture in a combustion chamber of an internal combustion engine by a corona discharge produced in the combustion chamber. This corona ignition system has an ignition electrode, which is surrounded by an insulator. The ignition electrode, the insulator and a sleeve surrounding the insulator together form an electrical capacitor. This capacitor is part of an electrical resonating circuit of the corona ignition device, which resonating circuit is excited with a high-frequency AC voltage for example from 30 kHz to 50 MHz. This results in a voltage excess at the ignition electrode so that a corona discharge forms at said electrode.

The high-frequency AC voltage is produced by a high-frequency generator. The input voltage of the high frequency generator is produced by a converter from the on-board supply voltage of the vehicle. The input voltage of the high-frequency generator generally is in the range from 100 V to 400 V in the case of known corona ignition systems.

A corona discharge creates ions and radicals in a fuel/air mixture in the combustion chamber of an engine. When a critical concentration of ions and radicals is reached, the fuel/air mixture ignites. The rate at which ions and radicals are created is dependent on the size of the corona discharge and the electrical power thereof. The size and power of a corona discharge can only increase up to a critical limit. If this limit is exceeded, the corona discharge transitions into an arc discharge or spark discharge.

Corona ignition systems are therefore controlled such that the corona discharge is as large as possible, and therefore the fuel/air mixture can be ignited as quickly as possible and the moment of ignition can thus be controlled as precisely as possible, however a breakdown of the corona discharge into an arc or spark discharge is avoided.

For this purpose, it is known from US 2011/0114071 A1 to measure the impedance of the resonating circuit. The impedance is compared with a fixed target value for the impedance, which is selected such that the corona ignition can be maintained without resulting in complete voltage breakdown.

This method has the disadvantage that the formation of the corona is not optimal and in particular an optimal size of the corona is not always achieved. The corona becomes larger, the closer the resonating circuit is operated to the breakdown voltage. In order to avoid the breakdown voltage in all circumstances, the target value of the impedance, which must not be exceeded, therefore must be so low that a voltage breakdown and therefore a spark discharge are avoided in any case.

SUMMARY

The present invention provides a way in which a corona discharge of maximum size can be produced and arc discharges or voltage flashovers can be largely avoided.

In a method according to this disclosure, it is determined by evaluation of the combustion onset whether the resonating circuit of the corona ignition system is excited with an optimal voltage. If, by evaluation of the combustion onset, it is found that a predefined requirement is no longer met, the target value of the AC voltage with which the resonating circuit is excited is increased. In this way a compensation of wear can be attained for example.

An excessively low voltage can be identified on the basis of a tardy combustion onset or an excessively strong scattering of the combustion onset. In other words, if the combustion onset lies significantly beyond a reference value, the corona discharge can be enlarged by increasing the excitation voltage of the resonating circuit and the combustion onset can be brought forward. Alternatively or additionally, the excitation voltage of the resonating circuit can also be increased if a comparison of a characteristic variable of the scattering of the combustion onset with a reference value indicates that the scattering exceeds a predefined extent. The variance may be used as the characteristic variable of the scattering, for example.

In order to prevent the resonating circuit of the corona ignition system from being excited with an excessively high AC voltage and producing an arc discharge, the target value of the AC voltage with which the resonating circuit is excited is repeatedly reduced by a predefined value $\Delta U$. If a predefined requirement is also met with the reduced AC voltage, for example a combustion onset that is not too late or a scattering of the combustion onset that is not too large, the reduced AC voltage is adopted as a new target value for the current engine operating state. If, however, the predefined requirement is no longer met with the reduced AC voltage, the performed reduction is not maintained, but is overcompensated, i.e. the original target value valid prior to the reduction is increased, for example by the value $\Delta U$.

If the combustion delay persistently exceeds the reference delay in spite of increasing the target voltage, or if the target voltage set by the method according to this disclosure exceeds a voltage threshold defined for this operating point, the engine control unit can be informed that the igniter has reached a state of wear. The engine control unit for example can then avoid critical engine states for which the present combustion delay is particularly unfavourable, extend the ignition period and/or inform the driver of the need to replace the igniter.

In a refinement of this disclosure, the target value of the AC voltage is reduced by a predefined value whenever a predefined number of engine cycles or a predefined operating time has passed, and the combustion onset determined with the reduced target value of the AC voltage is evaluated in one or more engine cycles by comparing the combustion onset with a reference value for the momentary operating state of the engine. The target value of the AC voltage for the momentary engine operating state is then increased by more than the predefined value if the determined combustion onset lies after the reference value. Otherwise, the reduced target value is stored as a new target value for the momentary engine operating state.

In a further refinement of this disclosure, the target value of the AC voltage is reduced by a predefined value whenever a predefined number of engine cycles or a predefined operating time has passed. The combustion onset determined with the reduced target value of the AC voltage is then evaluated for a number of engine cycles by comparing a characteristic variable of the scattering of the combustion onset with a reference value. The target value of the AC voltage for the momentary engine operating state is then increased by more than the predefined value if the comparison of the characteristic variable with the reference value reveals excessively high scattering. Otherwise, the reduced target value is stored as a new target value for the momentary engine operating state.

Each reduction of the target value of the AC voltage is a test to determine whether a corona discharge that is practically just as good can be produced with a lower excitation voltage of the resonating circuit. By consistently reducing the target value of the AC voltage again and again, it is therefore possible to generally hold the AC voltage at the lower edge of the optimal range and to thus maintain a sufficient distance from a critical voltage at which an arc discharge forms.

The target value of the AC voltage may, e.g., be reduced always after a predefined number of engine cycles, for example after each tenth or each fiftieth engine cycle. Another possibility lies in reducing the target value for AC voltage following a predefined period of time, for example every 10 seconds.

The steps in which the target value of the AC voltage is reduced can be fixedly predefined as absolute values or can be determined relative to the momentary target value. The predefined value ΔU by which the AC voltage is reduced is preferably at most 2% of the target value of the AC voltage, preferably no more than 1%. In this way, the corona discharge can change only slightly with a reduction of the target value of the AC voltage. If the target value is changed, the corona discharge will in many cases worsen. However, if the change is small any worsening is usually so small that the engine operation will not be significantly impaired.

The target value of the AC voltage with which the resonating circuit is excited can be set explicitly as a target value of the output voltage of the high-frequency generator. It is also possible to indirectly define the target value of the AC voltage with which the resonating circuit is excited via the input voltage of the high-frequency generator. If, specifically, a target value for the input voltage of the high-frequency generator is set, a target value for the output voltage of the high-frequency generator with which the resonating circuit is excited is implicitly also set. The value of the output voltage of the high-frequency generator is defined by the value of the input voltage of the high-frequency generator.

As already mentioned, the combustion onset can be evaluated by comparing the combustion onset with a reference value. The predefined requirement in this case is that the combustion starts at the latest at a crankshaft angle defined by the reference value.

Another possibility for evaluation lies in comparing a reference value with a characteristic variable of the scattering of the combustion onset determined with the reduced target value of the AC voltage in a number of engine cycles. For this evaluation, the reduced target value of the AC voltage has to be maintained for a number of engine cycles so that a number of values of the combustion onset can be determined for the reduced target value of the AC voltage. A characteristic variable of the scattering, for example the variance, can then be determined from these values of the combustion onset. The predefined requirement may in this case be that the scattering must not exceed a maximum permissible amount.

For a method according to this disclosure, it is sufficient to perform one of the two described possibilities of evaluation. However, the two above-described possibilities of evaluation can also be combined in a method according to this disclosure. For example, the combustion onset can be compared with a reference value for the first engine cycle following a reduction of the target value of the AC voltage. If the combustion onset is later than the reference value, the reduction is reversed and the target value is additionally increased. If no significant shift of the combustion onset was determined, the scattering of the combustion onset can be evaluated for a predefined number of engine cycles, for example five engine cycles or more. If it is thereby determined here that the scattering of the combustion onset exceeds a predefined amount, the reduction of the target value of the AC voltage can still be reversed, and the target value can be increased above the value valid prior to the reduction.

If, in a method according to this disclosure, after a reduction of the target value of the AC voltage by a value ΔU it is detected by evaluation of the combustion onset in one or more engine cycles that one or more predefined requirements are no longer met, the target value can be increased by a fixed value, for example by twice the predefined value ΔU or more.

Another possibility is to make the increase dependent on the extent of the deviation from a requirement defined by a reference value. Thus, if a reduction of the target value of the AC voltage by a value ΔU means that a predefined requirement is no longer met, this reduction can be reversed by adding the value ΔU to the momentary target value and additionally also adding a value $U_k$ to the target value, this value $U_k$ being dependent on how far the combustion onset lies after the reference value or on the extent to which the scattering of the combustion onset exceeds a permissible maximum amount. The value $U_k$ for example can be proportional to the value by which the combustion onset exceeds the reference value or proportional to the value by which a characteristic variable of the scattering of the combustion onset exceeds a reference value. The value $U_k$ can also be disproportionally dependent on the extent to which a requirement defined by a reference value is not met.

Reference values for the combustion onset in different engine states or a characteristic variable of the scattering of the combustion onset can be set by the manufacturer for example or can be determined from values of past engine cycles.

The combustion onset can be seen in the progression of electrical variables of the resonating circuit, for example the resonance frequency, the impedance or the phase position between current and voltage. As is explained in US 2013/0319095 A1incorporated therein by reference, the combustion onset can be identified on the basis of an extremum of electrical variables of the resonating circuit. For example, a local extremum occurs in the profile of the impedance and resonance frequency of the resonating circuit at combustion onset. The combustion onset therefore can be determined by an evaluation of an electrical variable of the resonating circuit.

By means of the evaluation of one or more electrical variables of the resonating circuit, any arc discharge can also be detected. In a refinement of this disclosure, if an arc discharge is detected, the target voltage is reduced preferably by a value that is greater than the predefined value ΔU by which the target value of the AC voltage is reduced following a predefined number of engine cycles or following a predefined operating period. For example, the target value of the AC voltage can be reduced in the event of detection of an arc discharge by three times or more the value ΔU by which the target value of the AC voltage is reduced following a predefined number of engine cycles or following a predefined operating period.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein:

FIG. 1 shows a schematic illustration of a corona ignition system.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

The corona ignition system illustrated schematically in FIG. 1 comprises a central unit 1 and a plurality of igniters 5, which are connected to the central unit 1 and which each comprise a resonating circuit 5*b* with an ignition electrode 5*a*. Each of these igniters 5 is associated with a combustion chamber of a cyclically operating engine and produces a corona discharge at the ignition electrode 5*a* thereof.

The central unit 1 comprises a step-up converter 3, a plurality of high-frequency generators 4, which are connected to the step-up converter and which are connected to the individual igniters 5, and a control unit 2 which controls the step-up converter 3 and the high-frequency generators 4. The step-up converter 3 produces an input voltage from an on-board supply voltage of the vehicle. This input voltage is provided to the high-frequency generators 4. The high-frequency generators 4 each produce from this input voltage an alternating voltage with which the resonating circuit 5*b* of the igniter 5 connected to the high-frequency generator 4 in question is excited.

The control unit 2 contains a memory, in which target values of the AC voltage produced by the high-frequency generators 4 are stored for different engine operating states. The target values can be stored in a matrix or a characteristics map. The control unit 2 may explicitly store target values for the output voltage of the high-frequency generators 4 or alternatively may set target values for the input voltage of the high-frequency generators 4, since the output voltage of the high-frequency generators 4 and thus the AC voltage with which the resonating circuits 5*b* of the igniters 5 are excited is defined by the input voltage of said high-frequency generators.

When the corona ignition system is used for the first time, target values provided by the manufacturer may initially be stored in the memory of the central unit 2.

During operation of the corona ignition system the target value is repeatedly reduced by a predefined value ΔU, for example whenever a predefined operating time has or a defined number of engine cycles have passed. The operating time and the number of engine cycles may be counted in an absolute manner, or may refer only to the current engine operating state.

The control unit 2 determines the combustion onset of the fuel in the combustion chamber of the engine from the electric characteristic variables of the resonating circuit 5*b* of the igniter 5 in question. The combustion onset can be identified for example on the basis of an extremum in the progression of an electrical variable of the resonating circuit 5*b*, in particular on the basis of a local maximum of the impedance or a local minimum of the resonance frequency of the resonating circuit 5*b*. Details concerning the determination of the combustion onset are explained in US 2013/0319095 A1incorporated herein by reference.

The control unit 2 then compares the combustion onset determined with the reduced target value with a reference value. Reference values for the combustion onset in the different engine operating states are stored in the memory of the control unit 2, for example in a matrix or a characteristics map.

If a comparison of the combustion onset with the reference value for the engine operating state in question reveals that a predefined requirement is no longer met, that is to say for example the combustion onset is later than the reference value, the target value is increased by a value that is greater than the value ΔU by which the target value was previously reduced. For example, the target value can be increased by a value 2ΔU or more. If the evaluation of the combustion onset has revealed that the combustion onset has deteriorated by the reduction of the target value, such that it no longer meets the requirements defined by the reference value, this reduction is reversed and the target value is increased to a value higher than before the reduction.

If, otherwise, it is determined by evaluation of the combustion onset that the predefined requirement or the predefined requirements are still met, that is to say for example the combustion onset has not shifted behind the reference value, the reduced target value is maintained until a renewed reduction of the target value has been performed after some time. By way of example, the target value can be reduced at predefined intervals, for example 10 seconds or more, or following a predefined number of engine cycles, for example 20 engine cycles or more.

The evaluation of the combustion onset by comparison with a reference value can be replaced or supplemented by detecting the combustion onset for a number of successive engine cycles and evaluating the scattering of the combustion onset. A small scattering is typical for a well-configured corona ignition system, whereas a large scattering indicates that the resonating circuit 5*b* is excited with a voltage that is too low. In order to evaluate the scattering, the control unit 2 can calculate a characteristic variable of the scattering of the combustion onset, for example the variance. This characteristic variable of the scattering is then compared with a reference value of the scattering. If this comparison reveals an excessively high scattering, for example if the variance exceeds the reference variable, the target value is increased, for example by a value of 2ΔU or more.

The reduction of the target value by the predefined value ΔU should not be so great that the engine operation is significantly disturbed thereby. If the predefined value ΔU is no more than 2% of the target value, a disruption of the engine operation can generally be avoided, even if the target value following a reduction by 2% is in many cases too low for optimal engine operation. For example, the predefined value ΔU can be selected so as to be so small that it is no more than 1% of the momentary target value of the AC voltage with which the resonating circuit 5*b* is excited. The value ΔU can be predefined as an absolute value in volts or as a fraction of the momentary target value. The value ΔU can set in a constant manner or can be set in a variable manner by the control unit 2, for example depending on the engine operating state.

If, after a reduction of the target value, it is determined from one or more engine cycles by evaluation of the combustion onset that a predefined requirement is no longer met, the momentary target value can be increased by a fixed value, for example always by 2ΔU or more. Another possibility lies in making the increase dependent on the extent to which a predefined requirement was missed, for example the extent to which a predefined reference value was exceeded. If, for example, the combustion onset is too late, the increase of the target value can be selected so as to be proportional to the value by which the combustion onset lies behind the reference value. It is also possible to determine the increase value using a non-linear function of the deviation of the combustion onset from the reference value.

When the scattering of the combustion onset is evaluated, the increase of the target value can also be determined by a function or characteristic variable of the scattering, for example the variance. If the variance or another characteristic variable of the scattering exceeds a predefined reference value, the target value can be increased by a value that is proportional to the difference between the variance or another characteristic variable of the scattering and the reference value. The increase of the target value can also be chosen to be disproportional to the deviation.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for controlling a corona ignition system of a cyclically operating internal combustion engine, the method comprising:

producing a corona discharge at an ignition electrode by exciting a resonating circuit with an AC voltage produced by a high-frequency generator, said resonating circuit comprising the ignition electrode;

adjusting the AC voltage to a target value that is set as a function of an operating state of the engine;

detecting a combustion onset by evaluating an electrical variable of the resonating circuit; and evaluating the combustion onset from one or a number of engine cycles, wherein the target value of the AC voltage is increased if, by evaluation of the combustion onset, it is determined that a predefined requirement is no longer met.

2. The method according to claim 1, wherein:

the target value of the AC voltage is reduced by a predefined value whenever a predefined number of engine cycles or a predefined operating period has passed;

the combustion onset determined with the reduced target value of the AC voltage is evaluated for one or more engine cycles; and if it is determined from the evaluation of the combustion onset that the predefined requirement is no longer met, the target value of the AC voltage for the engine operating state is increased by more than the predefined value, and, if it is determined by the evaluation of the combustion onset that the predefined requirement is still met, the reduced target value is stored as a new target value for the engine operating state.

3. The method according to claim 1, wherein the combustion onset is evaluated by being compared with a reference value for the operating state of the engine, wherein the predefined requirement is met when the combustion onset does not exceed the reference value.

4. The method according to claim 1, wherein the combustion onset is evaluated by comparing a characteristic variable of a scattering of the combustion onset with a reference value, wherein the predefined requirement is met when the combustion onset does not exceed the reference value.

5. The method according to claim 4, wherein the characteristic variable of the scattering is the variance.

6. The method according to claim 2, wherein, if, by evaluation of the combustion onset, it is determined that the requirement defined by a reference value is no longer met, the target value of the AC voltage is increased by a value that is dependent on the deviation from the reference value.

7. The method according to claim 1, wherein the predefined value is fixed as an absolute value.

8. The method according to claim 1, wherein the target value of the AC voltage is increased at least by twice the predefined value if, by evaluation of the combustion onset in one or more engine cycles, it is determined that the predefined requirement is no longer met.

9. The method according to claim 1, wherein the predefined value is at most 2% of the target value of the AC voltage.

10. The method according to claim 1, wherein, by evaluating an electrical variable of the resonating circuit, it is monitored whether an arc discharge occurs and, if so, the target value of the AC voltage is reduced by a value that is greater than the predefined value by which the target value of the AC voltage is reduced following a predefined number of engine cycles or following a predefined operating period.

* * * * *